US005262767A

United States Patent [19]

Takeda

[11] Patent Number: 5,262,767

[45] Date of Patent: * Nov. 16, 1993

[54] DISPLAY CONTROL DEVICE

[75] Inventor: Hiroshi Takeda, Kodaira, Japan

[73] Assignee: Hitachi, Ltd., Tokyo, Japan

[ * ] Notice: The portion of the term of this patent subsequent to Mar. 6, 2007 has been disclaimed.

[21] Appl. No.: 727,421

[22] Filed: Jul. 9, 1991

Related U.S. Application Data

[63] Continuation of Ser. No. 448,831, Dec. 12, 1989, Pat. No. 5,043,717, which is a continuation of Ser. No. 281,966, Nov. 30, 1988, Pat. No. 4,906,986, which is a continuation of Ser. No. 875,679, Jun. 18, 1986, abandoned.

[30] Foreign Application Priority Data

Jun. 21, 1985 [JP] Japan ..... 60-134006

[51] Int. Cl.[5] ..... G09G 1/16

[52] U.S. Cl. ..... 345/133; 345/189

[58] Field of Search ..... 340/701, 703, 723, 724, 340/728, 732, 744, 747, 750, 789, 798, 799; 434/96

[56] References Cited

U.S. PATENT DOCUMENTS

| | | | |
|---|---|---|---|
| 4,225,861 | 9/1980 | Langdon, Jr. et al. | 340/703 |
| 4,646,076 | 2/1987 | Wiedenman et al. | 340/747 |
| 4,646,078 | 2/1987 | Knierim et al. | 340/750 |
| 4,656,468 | 4/1987 | Takikawa et al. | 340/747 |
| 4,658,247 | 4/1987 | Gharachorloo | 340/703 |
| 4,755,810 | 7/1988 | Knierim | 340/799 |
| 4,763,119 | 8/1988 | Matsubara et al. | 340/728 |
| 4,906,986 | 3/1990 | Takeda | 340/799 |
| 5,043,717 | 8/1991 | Takeda | 340/799 |

*Primary Examiner*—Richard Hjerpe

*Attorney, Agent, or Firm*—Antonelli, Terry, Stout & Kraus

[57] ABSTRACT

A CRT controller having a drawing function includes designation means to designate a predetermined area of an external memory as a reference area for tiling, and a drawing processor which transmits a display pattern in the reference area designated by the designation means, to a drawing area of the external memory. Since the CRT controller of this construction permits the use of the external memory easy of enlarging the capacity thereof for a tiling pattern, it realizes the tiling processing with a complicated tiling pattern.

12 Claims, 12 Drawing Sheets

DISPLAY CONTROL DEVICE

This application is a continuation of application Ser. No. 448,831, filed Dec. 12, 1989 now U.S. Pat. No. 5,043,717, issued Aug. 27, 1991, which is a continuation of application Ser. No. 281,966, filed Nov. 30, 1988, now U.S. Pat. No. 4,906,986, issued Mar. 6, 1990, which is a continuation of application Ser. No. 875,679, filed Jun. 18, 1986, now abandoned.

BACKGROUND OF THE INVENTION

This invention relates to display control technology. More particularly, it relates to a technique which is especially effective when applied to a control system for a display device, such as a CRT display, for example, a display control system in a CRT controller constituting a graphic display system as in a personal computer.

Heretofore, various CRT controllers for controlling CRT displays instead of MPUs have been proposed as LSIs each of which serves as a graphic display system as in a personal computer furnished with the CRT display and having a graphic video processing function.

An example of a, CRT Controller is manufactured by Hitachi Ltd. and includes therein a graphic pattern RAM (random access memory) of, e.g., 16×16 bits with which a function called 'tiling' can be performed in which a pattern drawn in the RAM is repeatedly displayed on the desired area of the display screen of a CRT display to smear out the area. (Refer to "HD63484ACRTC Users'Manual" published in June, 1984 by Hitachi Ltd.)

The CRT controller having a RAM as described above,(hereinbelow, called a 'pattern RAM') has the advantage that the tiling with any desired pattern can be performed at high speed. However, the capacity of the pattern RAM which can be built in the CRT controller cannot be considerably enlarged because of the limitation of the chip size. It is therefore impossible to keep a very complicated pattern written in the pattern RAM. Moreover, since color information is handled with the two values of "1" and "0", the number of colors which can be used at a time is restricted to two, and the pattern becomes monotonous. A further drawback is that, each time the pattern is changed, an MPU or the like needs to externally draw a desired pattern in the internal pattern RAM, so that the burden on the MPU is heavy.

SUMMARY OF THE INVENTION

An object of this invention is to make it possible to tile any desired closed area on the display screen of a CRT display with a complicated pattern, thereby to expand a graphic display function in a display control device such as CRT controller without increasing the burden on an external MPU or the like.

Another object of this invention is to raise the speed of drawing processing in a graphic display system.

The aforementioned and other objects and novel features of this invention will become apparent from the description of this specification as well as the accompanying drawings.

A typical aspect of performance of the present invention will be summarized below.

This invention consists in that an external memory such as frame buffer is used in place of and as a pattern RAM which is provided in a CRT controller for the tiling processing of a fixed area on a display screen, etc., to achieve the aforementioned object of realizing the tiling processing with a comparatively complicated and large reference pattern and expanding the graphic display function of the display control device such as CRT controller without increasing the burden on the MPU.

BRIEF DESCRIPTION OF THE DRAWINGS

FIGS. 5A and 5B illustrate an example of the tiling processing of a closed area employing a reference pattern in the first embodiment of the present invention, in which FIG. 5A is an explanatory diagram showing a state before the processing while FIG. 5B is an explanatory diagram showing a state after the processing;

PREFERRED EMBODIMENTS

Embodiment 1

Figure 1:
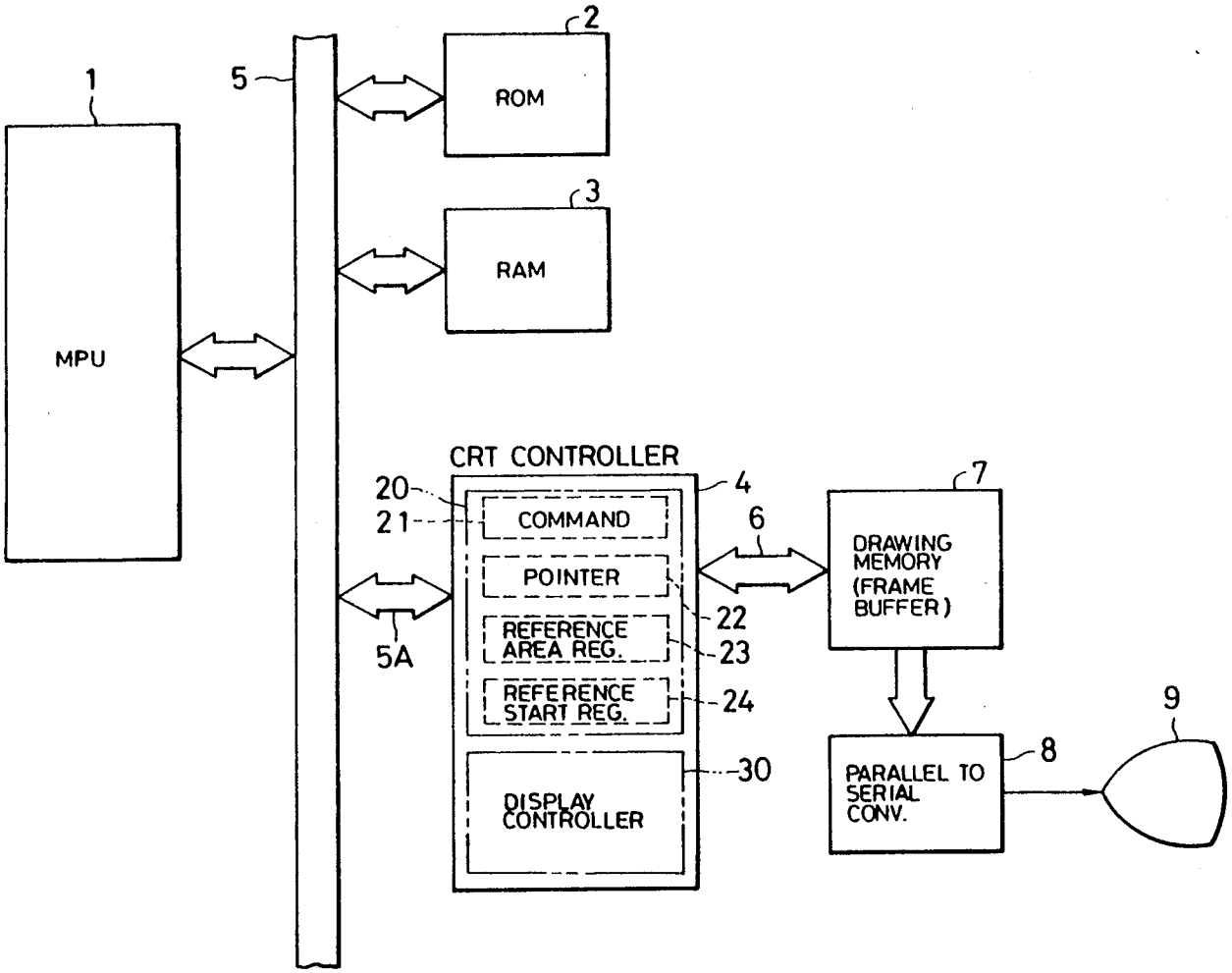
FIG. 1 is a block diagram showing a first embodiment of a graphic display system to which a display control device according to the present invention is applied.

FIG. 1 shows a first embodiment in the case where the present invention is applied to a graphic display system as in a personal computer.

A microprocessor 1, a system ROM 2 in which a system program is stored, a RAM 3 for storing data, a CRT controller 4, etc. are coupled to one another by a system bus 5. Though not shown, a key input device and a floppy disk device which are succeeded by an input/output unit (I/O), a DMA controller which transfers data directly between the floppy disk device and a drawing memory for storing display drawing data, and so forth are sometimes connected to the system bus 5.

The drawing memory 7 called a 'frame buffer' etc. is connected to the CRT controller 4 through a bus 6. This memory 7 is put under the control of the CRT controller 4.

The CRT controller 4 writes display data into the drawing memory 7 and reads out internal display data from the drawing memory 7 on the basis of commands from the microprocessor 1. The display data read out from the drawing memory 7 is supplied to a parallel-to-serial converter 8 and is converted into serial data, which is supplied to a CRT display 9. That is, the display data is displayed on the screen of the CRT display 9.

The drawing memory 7 under the control of the CRT controller 4 holds the display data in correspondence with dots on the display screen of the CRT display 9, namely, in accordance with the bit map system. In some cases, the drawing memory 7 is constructed of a plurality of memory planes so as to make it possible to designate color information for the respective dots.

In addition, the CRT controller 4 for use in this embodiment has at least functions as stated below.

The CRT controller 4 includes a drawing controller 20 of, for example, a microprogram control system in order to decode the drawing command supplied from the microprocessor 1 and control various internal registers and an ALU (arithmetic/logic unit) so as to write the display data into the drawing memory 7.

The drawing controller 20 is provided therein with a command register 21 which holds various drawing commands supplied from the microprocessor 1, and a pointer register 22 which serves to designate a drawing position on the drawing memory 7 (logical addresses indicated by coordinates X and Y). Also, the drawing controller 20 is provided therein with a reference area register 23 by which any desired area in the drawing memory 7 is defined as a reference pattern, and a reference start register 24 which designates a reference start point in the reference area thus defined, though this is not especially restrictive.

Further, the CRT controller 4 of this embodiment is provided therein with a display controller 30 which forms and delivers display addresses for the drawing memory 7 in synchronism with control signals such as horizontal and vertical synchronizing signals internally formed.

The CRT controller 4 having the above functions can be realized by somewhat altering hardware in an LSI, for example, ACRTC-HD63484 manufactured by Hitachi Ltd. so that instead of a pattern RAM provided therein, a partial area of an external frame buffer (the drawing memory 7) can be used as a reference area.

Accordingly, the area drawn on the display screen by the CRT controller 4 of this embodiment can be executed in accordance with steps similar to those of the controller having the pattern RAM.

Figure 2:
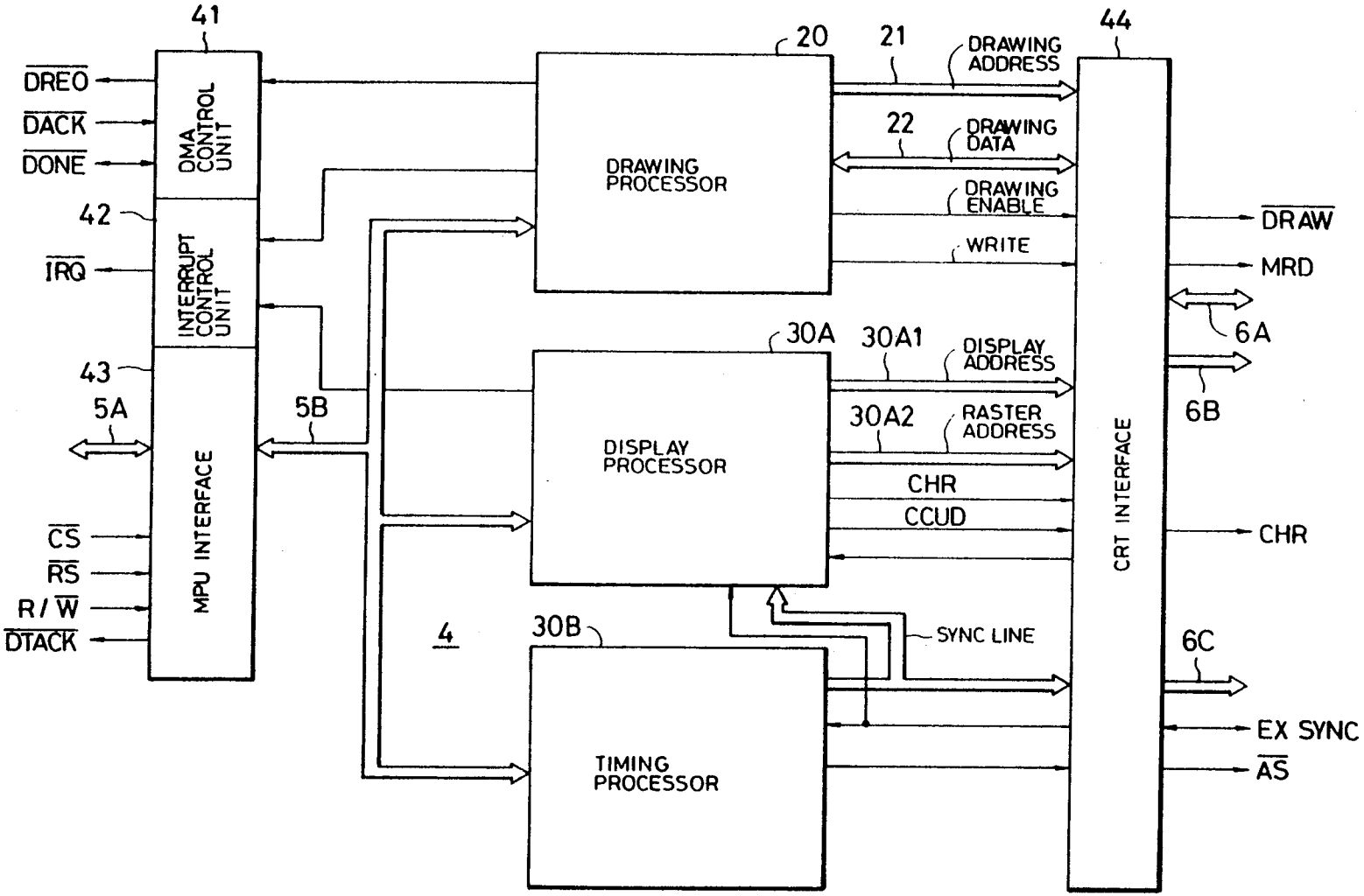
FIG. 2 is a block diagram of a CRT controller.

FIG. 2 shows a block diagram of the CRT controller 4.

The CRT controller 4 comprises a DMA control unit 41, an interrupt control unit 42, an MPU interface 43, a drawing processor 20, a display processor 30A, a timing processor 30B, and a CRT interface 44.

The DMA control unit 41 outputs a DMA transmission request signal $\overline{DREQ}$, inputs a DMA transmission request acknowledge signal $\overline{DACK}$, and inputs and outputs a done signal $\overline{DONE}$ so as to permit the coupling between the drawing processor 20 and a direct memory access controller.

The interrupt control unit 42 forms an interrupt request signal $\overline{IRQ}$ to be supplied to the MPU 1, in compliance with an interrupt request from the processor 20 or 30A.

The MPU interface 43 has a bidirectional data bus 5A, and it receives a chip select signal $\overline{CS}$, a register select signal $\overline{RS}$ and a read/write signal R/$\overline{W}$ and delivers a data transmission acknowledge signal $\overline{DTACK}$.

The display processor 30A and the timing processor 30B constitute the display controller 30 in FIG. 1.

The drawing processor 20 interprets a command and a parameter transmitted from the MPU and executes drawing processing for the frame buffer, whereas the display processor 30A controls the display address of the frame buffer 7 in accordance with a frame format to be displayed on the CRT.

The timing processor 30B forms CRT synchronizing signals and various timing signals required in the CRT controller.

The CRT interface 44 outputs to a terminal 6C the synchronizing signals such as horizontal and vertical synchronizing signals formed by the timing processor 30B, inputs/outputs an external synchronizing signal EX SYNC, outputs an address strobe signal $\overline{AS}$, outputs the drawing address of the drawing processor 20 and the display address of the display processor 30A to an address/data bus 6A and an address bus 6B, supplies the drawing processor 20 with data to be given from the frame buffer 7 to the address/data bus 6A, outputs a draw signal $\overline{DRAW}$ which indicates either a drawing cycle or a display cycle, outputs a memory read signal MRD which indicates the direction of the data transmission between the CRT controller 4 and the frame buffer 7 during the drawing cycle, and outputs an instruction signal CHR which instructs whether an address to be output to the address terminal 6B indicates an address of predetermined bits in the memory or a raster address.

The drawing processor 20, display processor 30A and timing processor 30B are respectively operated in accordance with the microprogram control system.

Figure 3:
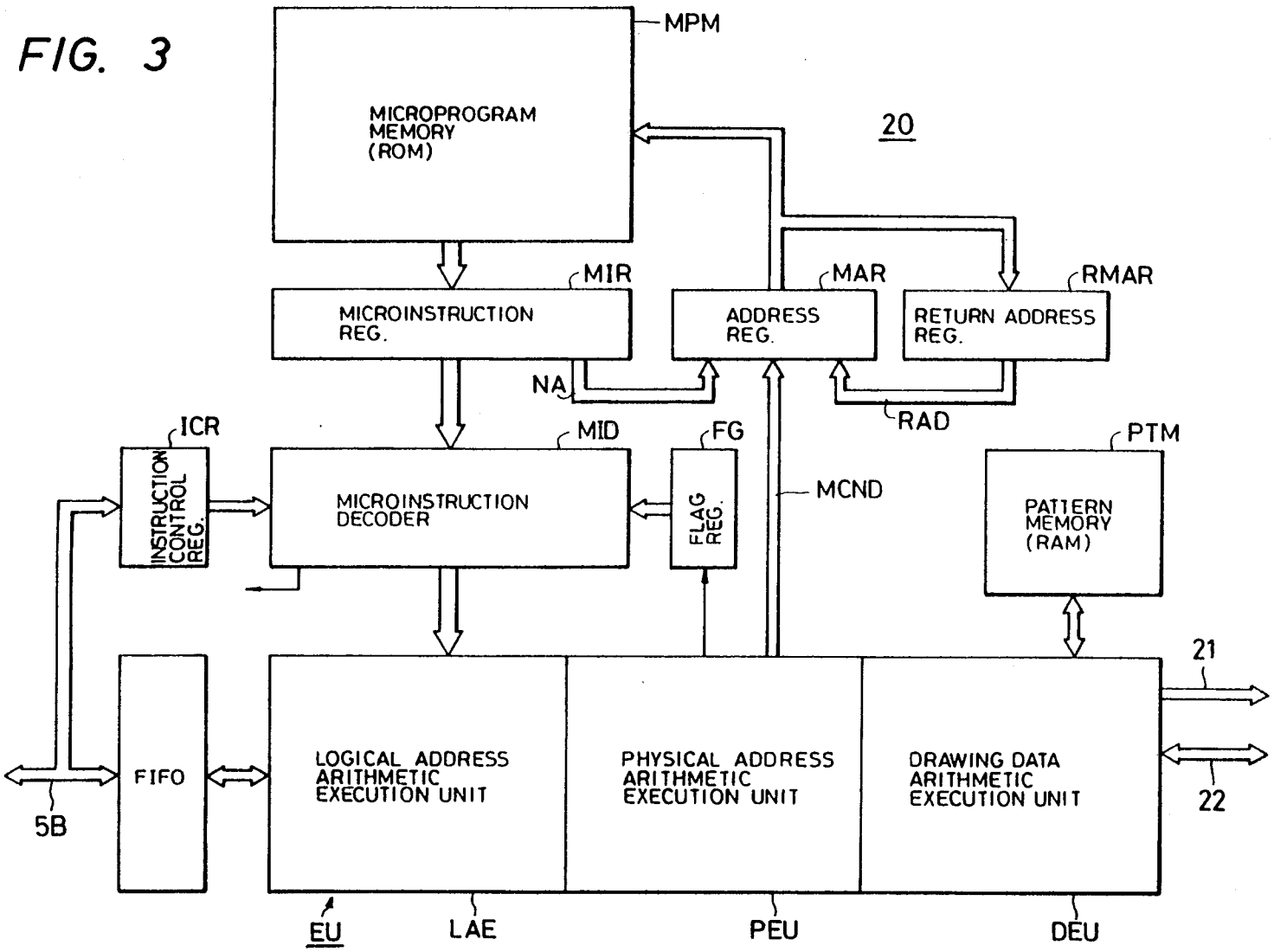
FIG. 3 is a block diagram of a drawing processor in FIG. 2.

FIG. 3 shows a block diagram of the drawing processor 20.

The drawing processor 20 comprises a first-in first-out register FIFO, an instruction control register ICR, a microprogram memory MPM as constructed of a ROM in which a microprogram is written, a microinstruction register MIR to which a microinstruction read out from the microprogram memory MPM is applied, a return address register RMAR which holds the return address of a subroutine, a microaddress register MAR which receives a next address among microinstructions delivered from the microinstruction register MIR, an instruction MCND in the drawing command, and one of return addresses delivered from the return address register RMAR and which forms a microaddress to be supplied to the microprogram memory MPM, a flag register FG, a microinstruction decoder MID which receives a microinstruction from the microinstruction register MIR, control data from the instruction control register ICR and flag data from the flag register FG thereby to form control signals, an execution unit $\underline{EU}$ whose operation is controlled by control signals delivered from the microinstruction decoder MID, and a pattern memory PTM which is coupled to the execution unit $\underline{EU}$.

The execution unit $\underline{EU}$ comprises a logical address arithmetic unit LAE which principally calculates where a drawing point exists in the screen, in accordance with a drawing algorithm, a physical address arithmetic unit PEU which calculates the address of the frame buffer 7, and a drawing data arithmetic unit DEU which forms drawing data to be written into the frame buffer 7.

Figure 4A:
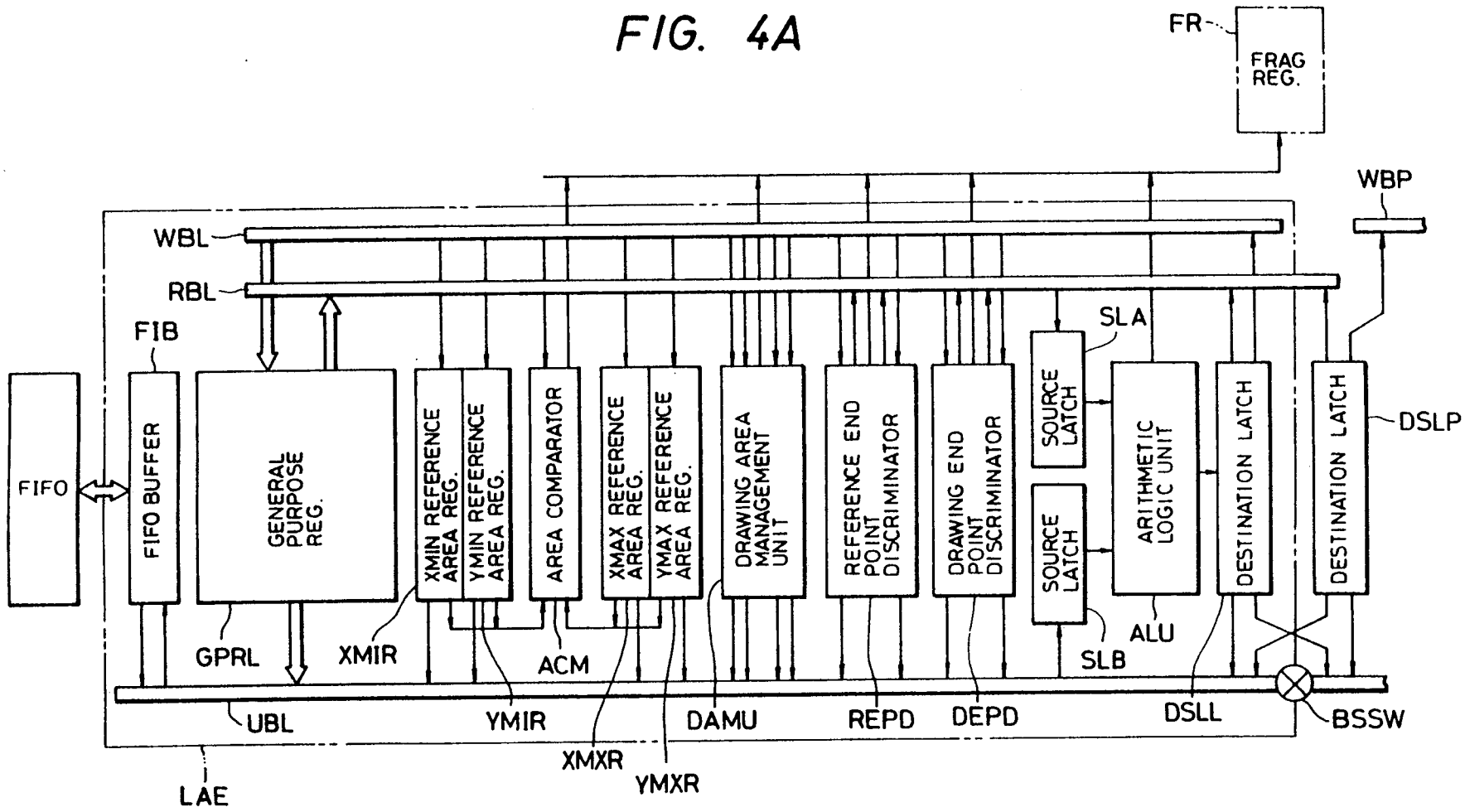
FIGS. 4A to 4C are more detailed block diagrams of the drawing processor in FIG. 3.

FIG. 4A chiefly shows the detailed blocks of the logical address arithmetic unit LAE.

The logical address arithmetic unit LAE comprises a FIFO buffer FIB, a general-purpose register GPRL, reference area management registers XMIR, YMIR, XMXR and YMXR, an area comparator ACM, a drawing area management unit DAMU, a reference end point discriminator REPD, a drawing end point discriminator DEPD, source latches SLA and SLB, an arithmetic logic unit ALU, a destination latch DSLL, a write bus WBL, a read bus RBL, an internal bus UBL, and a bus switch BSSW.

Figure 5A:
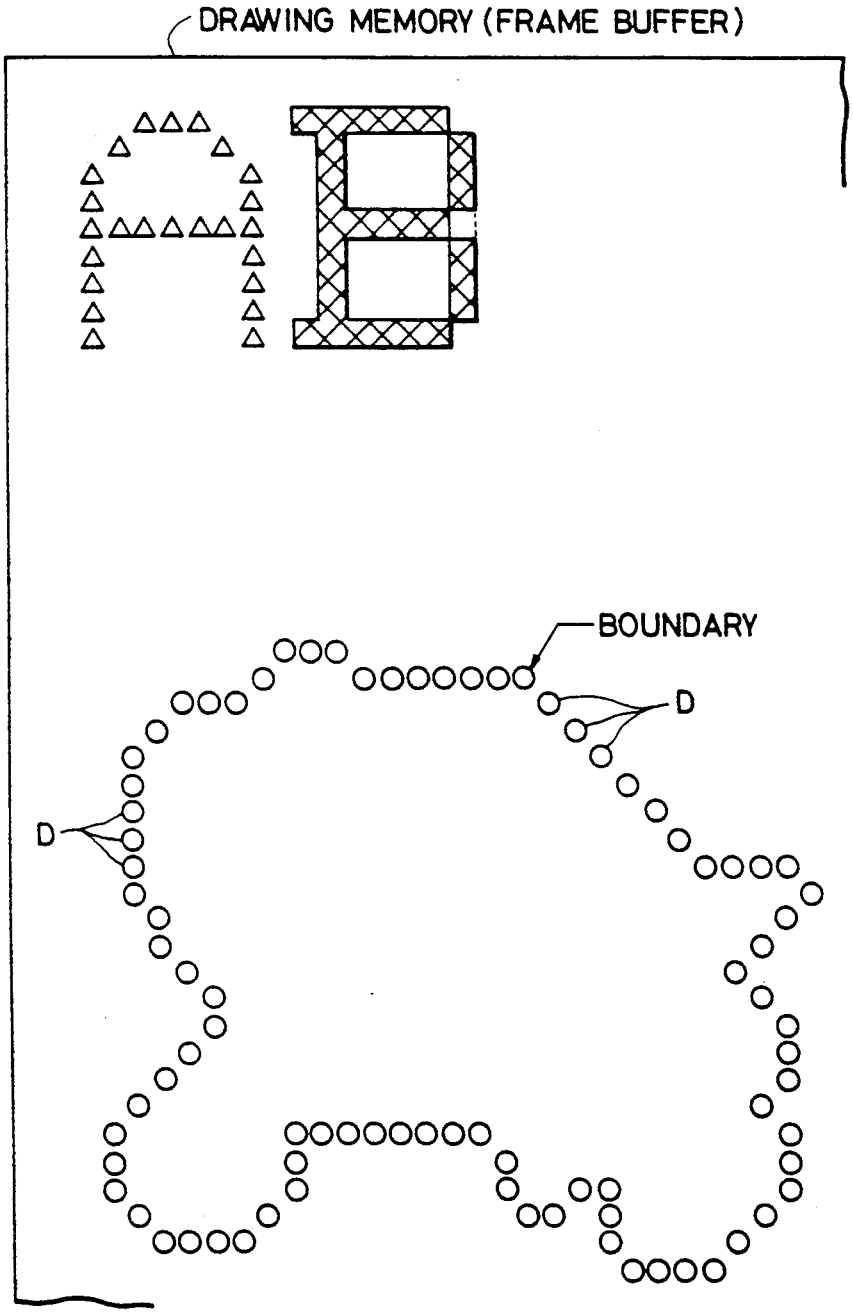
Figure 5B:
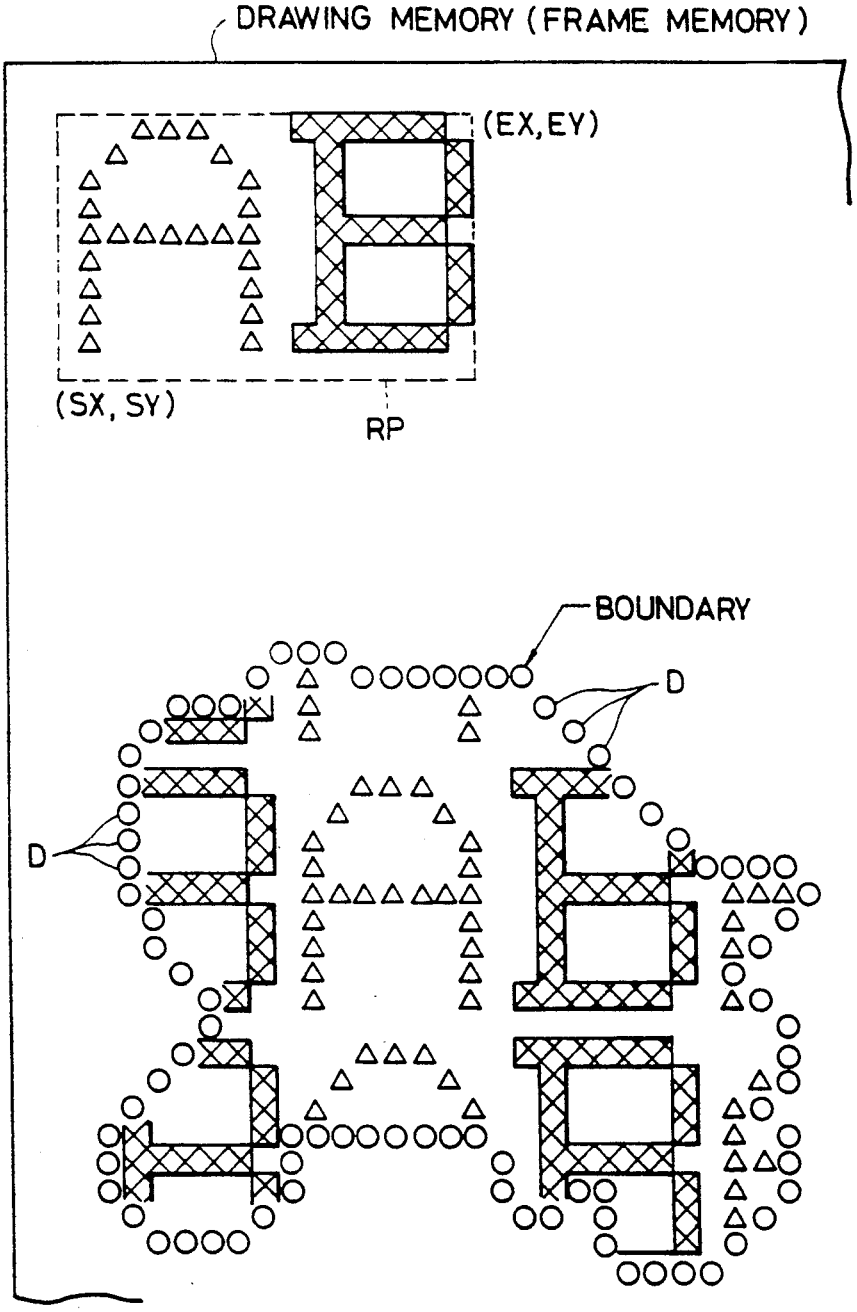

The reference area designation registers XMIR, YMIR, XMXR and YMXR constitute the reference area designation register 23 in FIG. 1, and reference data items SX, SY, EX and EY corresponding to -a reference area RP as shown in FIG. 5B are respectively set therein.

The area comparator ACM compares the reference data items supplied from the reference area designation registers and address data supplied through the write bus WBL. The output of the area comparator ACM is supplied to the flag register FR as flag data.

Although the drawing area management unit DAMU is illustrated as a simple block in order to avoid the complication of the drawing, it is constructed of registers similar to those XMIR, YMIR, XMXR and YMXR and a comparator similar to that ACM. Data items indicative of a drawing area are set in the registers in the unit DAMU.

Though not shown in detail, the reference end point discriminator REPD comprises registers in which X-axial data and Y-axial data at a reference end are set, and a comparator.

The drawing end point discriminator DEPD is constructed of a circuit similar to the circuit REPD.

Figure 4B:
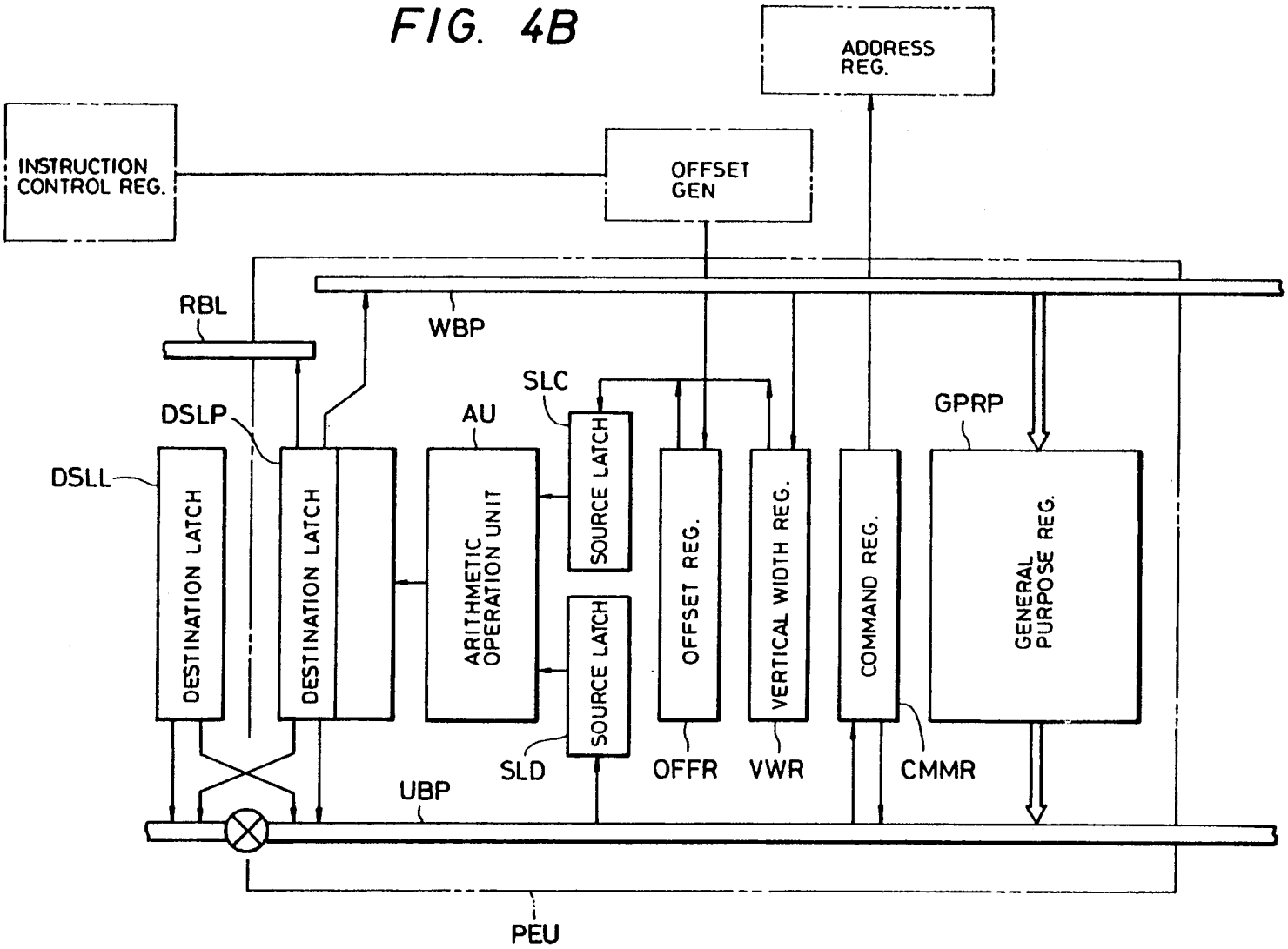

FIG. 4B chiefly shows the detailed blocks of the physical address arithmetic unit PEU.

The physical address arithmetic unit PEU comprises a destination latch DSLP, an arithmetic operation unit AU, source latches SLC and SLD, an offset register OFFR, a vertical width register VWR, a command register CMMR, a general-purpose register GPRP, an internal bus UBP, and a write bus WBP.

Figure 4C:
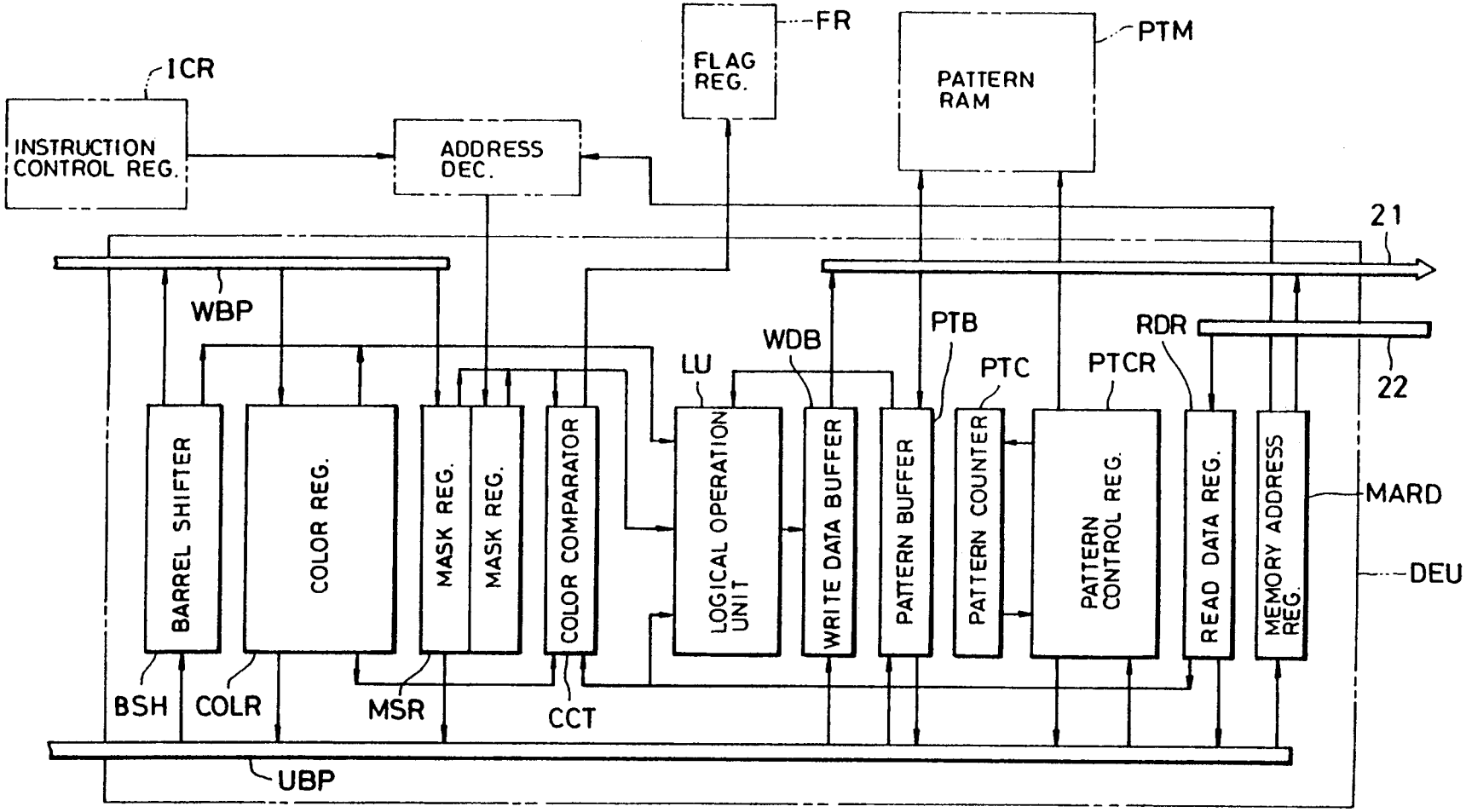

FIG. 4C chiefly shows the detailed blocks of the drawing data arithmetic unit DEU.

The drawing data arithmetic unit DEU comprises a barrel shifter BSH, a color register COLR, a mask register MSR, a color comparator CCT, a logical operation unit LU, a write data buffer WDB, a pattern RAM buffer PTB, a pattern counter PTC, a pattern control register PTCR, a read data buffer RDR, a memory address register MARD, a memory output bus 21, a memory input bus 22, and an internal bus UBP.

The write data buffer WDB is supplied with drawing data to be written into the frame buffer 7 in FIG. 1, while the read register RDR is supplied with data read out from the frame buffer 7. In addition, the memory address register MARD is supplied with address data for the frame buffer 7.

The CRT controller illustrated in FIG. 3 and FIGS. 4A–4C has substantially the same arrangement as an arrangement in which the reference area designation registers XMIR, YMIR, XMXR and YMXR, the comparator ACM and the reference end point discriminator REPD (FIG. 4A) are added to a video processor disclosed in Japanese Patent Application No. 58-246986.

The operation of the CRT controller 4 will be outlined below.

Control data items such as commands and parameters sent from the other units or devices such as the microprocessor 1 are written into the FIFO on one hand, and are written into the instruction control register ICR on the other hand.

In the instruction control register ICR, mode specifying data items for specifying various drawing bit modes are set. The drawing bit modes consist of a 1-bit/picture element mode, a 2-bit/picture element mode, a 4-bit/picture element mode, and an 8-bit/picture element mode.

The command stored in the FIFO is stored into the command register CMMR in the physical address arithmetic unit PEU through the FIFO buffer FIB, internal bus UBL, bus switch BSSW and internal bus UBP. The command stored in the command register CMMR is partly transmitted to the microaddress register MAR.

The microaddress register MAR has its operation controlled in accordance with a microinstruction delivered from the microprogram memory MPM. It delivers an address to be supplied to the microprogram memory MPM, on the basis of a next microaddress NA from the microinstruction register MIR, the partial code MCND of the command, or a return address RAD from the return address register RMAR.

The microinstruction read out of the microprogram memory MPM is supplied to the microinstruction decoder MID through the microinstruction register MIR. The microinstruction decoder MID responds thereto to provide control signals for controlling the execution unit EU.

When the partial code of one command, in other words, an instruction in the macro order has been loaded in the microaddress register MAR, a plurality of microinstructions are responsively read out from the microprogram memory MPM in succession. That is, a microprogram is executed.

The operation of the logical address arithmetic unit LAE proceeds as follows in accordance with the program:

The data fed into the FIFO buffer FIB is stored into a proper register through the internal bus UBL. It is also applied through the source latch SLB to the arithmetic logic unit ALU, in which a predetermined operation is executed, and the result of the operation is stored into the destination latch DSLL. The data stored in the destination latch DSLL is stored into the general-purpose register GPRL. A current coordinate point in a coordinate space is stored in the general-purpose register GPRL.

X- and Y-coordinate data items in the general-purpose register GPRL are input to the arithmetic logic unit ALU through either of the read bus RBL and the bus UBL. Data formed by the ALU is written into the general-purpose register GPRL again through the destination latch DSLL as well as the write bus WBL.

The data on the write bus WBL is supplied to the area comparator ACM, the drawing area management unit DAMU, etc. The compared results of these units ACM and DAMU are supplied to the flag register FG.

The flag register FG is also supplied with the output of the arithmetic logic unit ALU. The output of the flag register FG is supplied to the microinstruction decoder MID, and is used for changing the flow of the microprogram.

The operation of the physical address arithmetic unit PEU proceeds as follows:

Data formed by the arithmetic unit PEU is supplied to the general-purpose register GPRP. The data of the general-purpose register GPRP is input to the arithmetic operation unit AU through the bus UBP as well as the source latch SLD. A result calculated by the arithmetic operation unit AU is temporarily stored in the destination latch DSLP, and is delivered to the buses UBL, RBL, UBP, WBP etc. By way of example, the data of the latch DSLP is written into the general-purpose register GPRP through the write bus WBP. Thus, the physical address of an actual drawing point corresponding to a current drawing point is written into the general-purpose register GPRP. When X and Y coordinates in the general-purpose register GPRL of the logical address arithmetic unit LAE have moved, also a physical address in the general-purpose register GPRP moves responsively.

The operation of the drawing data arithmetic unit DEU proceeds as follows:

The physical address stored in the general-purpose register GPRP of the physical address arithmetic unit PEU is written into the memory address register MARD through the bus UBP. A memory address stored in the memory address register MARD is supplied to the frame buffer 7 through the output bus 21, the CRT interface 44 (FIG. 2) and the buses 6A and 6B. Data read out of the frame buffer 7 is supplied to the read data register RDR through the bus 6A, CRT interface 44 and input/output bus 22.

The logical operation unit LU executes a logical arithmetic operation on the basis of readout data from the read data register RDR, mask data from the mask register MSR, and color data from the color register COLR. The operated result of the logical operation unit LU is written into the write register WDB. Color information and pattern information are read out from the pattern RAM PTM which is designated by an address formed by the pattern counter PTC as well as the pattern control register PTCR, and they are written into the pattern buffer PTB. The data of the pattern buffer PTB is supplied to the color register COLR, the logical operation unit LU, etc.

Next, an example of pattern drawing by the CRT controller of the above embodiment will be described with reference to FIGS. 5A and 5B as to a case of performing the tiling processing of any desired closed area on a display screen.

Let's consider a case where display data as shown in FIG. 5A is written in the drawing memory 7, in which a closed area defined by successive boundary points D is to be tiled with a suitable pattern. It is assumed here that a pattern "AB" written in another area (the left upper corner in the figure) within the drawing memory 7 be used for the tiling.

Here, the boundary points D are set as stated below.

First, the tiling with the so-called painting method will be explained.

In this case, the difference between display data corresponding to the inner side of the closed area as shown in FIG. 5A and display data corresponding to at least the boundary dots D is utilized. In a case where, by way of example, the display data corresponding to the closed area is specified data signifying red while the display data corresponding to the outer area including the boundary points D is data signifying a color other than red, the closed area can be found by referring the display data. Even in a case where display data other than the boundary points D is not written in the frame buffer 7 beforehand, the closed area can be found by referring to such display data. Therefore, the detection of the boundary points D for the tiling based on the painting method is permitted by the reference to the display data in the pattern memory.

Next, the tiling with the so-called filling method will be explained.

In this case, pattern data which indicates the X and Y values of the respective points of a pattern and the mutual relations of the points is set in a memory, for example, the RAM 3 in FIG. 1. Display data to be set in the frame buffer 7 is formed by a drawing process which utilizes such pattern data. In this case, accordingly, the boundary points D can be found in such a way that the pattern data corresponding to a tiling area is referred to and is subjected to the drawing processing. Herein, needless to say, the display data which makes the discrimination of the boundary points D possible may be set in the frame buffer 7 or not.

In the tiling, first of all, a pattern start position SX, SY and pattern end position EX, EY indicated by X and Y coordinates are designated in the reference area designation register 23 within the drawing controller 20 of the CRT controller 4 by a command and a parameter supplied from the microprocessor 1. Thus, a rectangular reference area as indicated by a broken line RP in FIG. 5B is designated. Besides, an address in the closed area to be tiled (inside the boundary points D) is set in the pointer register 22 within the drawing controller 20, while a reference start point in the reference area RP is set in the reference start register 24.

Subsequently, the tiling drawing of the closed area is started. The CRT controller 4 reads out the data of the drawing position on the drawing memory 7 as indicated by the pointer register 22 and the data of the reference start point in the reference area RP as indicated by the register 24 and executes a predetermined drawing operation to form new data, which is written into the original position (the drawing of 1 dot). The drawing point is moved every dot in a raster direction (the horizontal direction), and it is shifted to the next raster upon colliding against the boundary point D. In addition, as the drawing point is moved, the content of the reference start register 24, namely, the reference point in the reference area RP is moved in the same direction.

In a case where the width of the tiling area is greater than that of the reference area RP; when the reference point has reached the pattern end position, it is returned to the pattern start position on the identical raster and is moved in the raster direction again. As the raster of the drawing points in the tiling area changes, the raster of the reference points in the reference area RP is similarly changed. In this manner, the drawing in the closed area is performed while the reference area is being referred to every dot, whereby as illustrated in FIG. 5B, the pattern "AB" in the reference area RP on the identical drawing memory 7 is repeatedly inlaid into any desired closed area so as to tile this area.

A pattern on the drawing memory 7 usually contains color information and is often expressed in multi-tonal fashion. In such a case, also the closed area employing the reference pattern can be readily tiled with a multi-tonal color pattern.

Further, according to this embodiment, it is unnecessary to add a memory anew to a conventional graphic display system employing a CRT controller or to alter the construction of the system. Moreover, when a pattern already drawn in the drawing memory 7 is used as the reference pattern, there is the advantage that the labor of drawing the reference pattern is not required at all.

Embodiment 2

Figure 6:
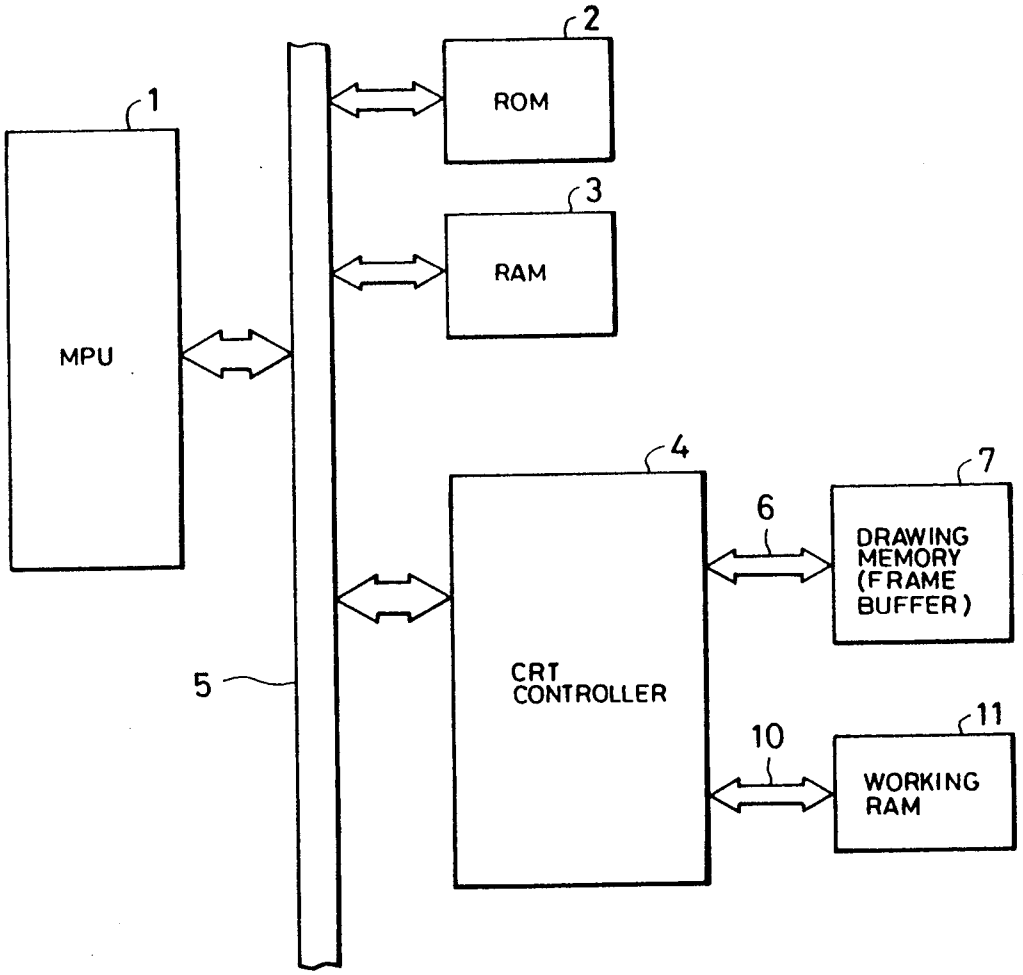
FIG. 6 is a block diagram showing a second embodiment of the present invention.

FIG. 6 shows a second embodiment of the present invention.

This embodiment is such that, besides a drawing memory (frame buffer) 7 connected to a CRT controller 4 through a bus 6, a working RAM 11 as a pattern RAM is connected to the CRT controller 4 through a bus 10. The CRT controller 4 can tile a desired closed area in the drawing memory 7 by properly extracting a pattern drawn in the working RAM 11 beforehand and inlaying the extracted patterns into the closed area in succession.

Figure 7:
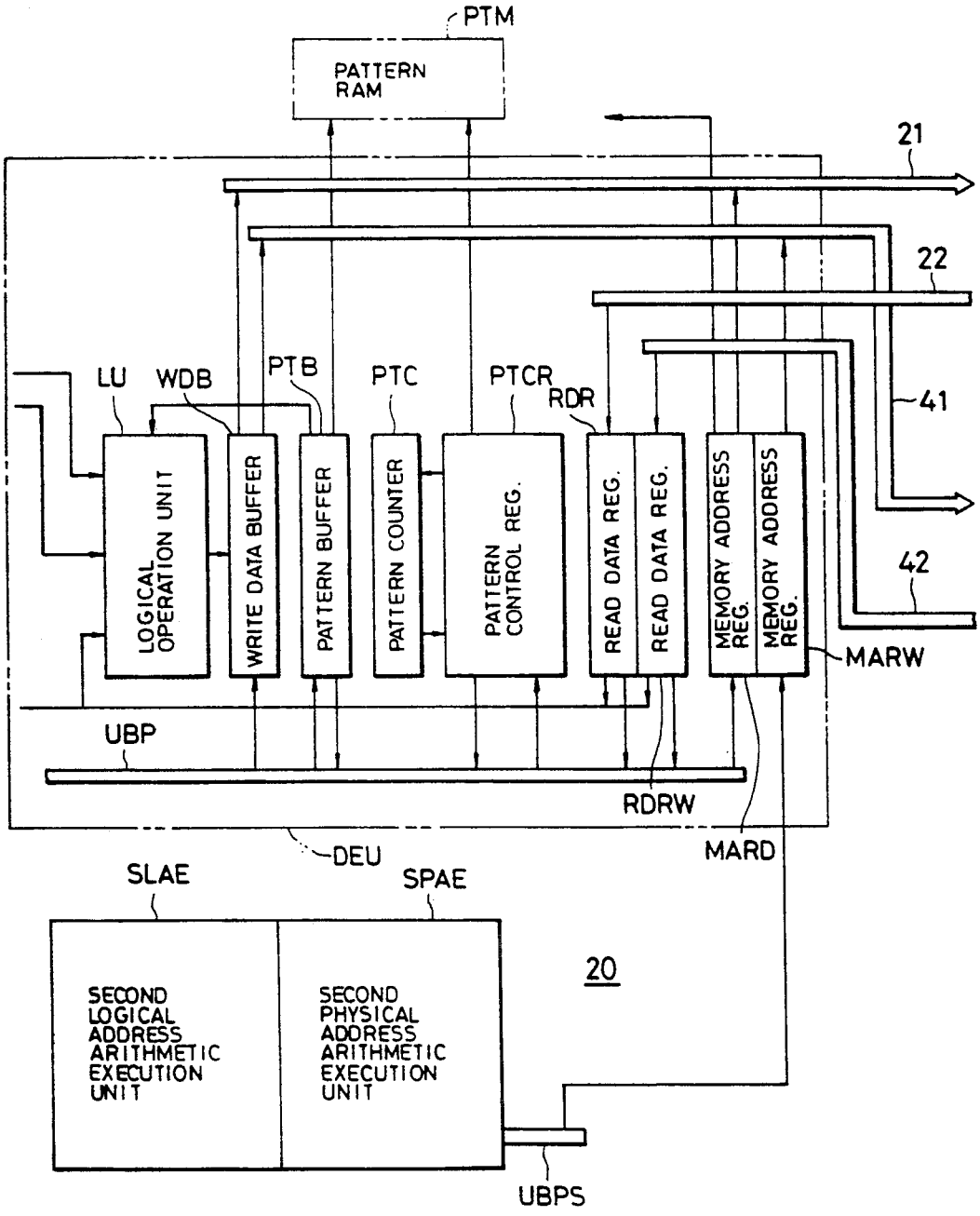
FIG. 7 is a block diagram for elucidating the embodiment of FIG. 6 more in detail.

Most of the CRT controller 4 is substantially the same as the first embodiment. However, the drawing processor 20 in the preceding embodiment is altered as follows:

As shown in FIG. 7, a drawing processor 20 in this embodiment has a drawing data arithmetic unit DEU which corresponds to the drawing data arithmetic unit DEU of the first embodiment, and also a second logical address arithmetic unit SLAE and a second physical address arithmetic unit SPAE which are not included in the first embodiment.

The second logical address arithmetic unit SLAE is operated so as to form a logical address for the working RAM 11. The reference area registers XMIR, YMIR, XMXR and YMXR, area comparator ACM and reference end point discriminator REPD which are provided in the logical address arithmetic unit LAE of the first embodiment are shifted to the second logical address arithmetic unit SLAE. The general-purpose register as a pointer for a reference area in the logical address arithmetic unit LAE is also shifted to the second logical address arithmetic unit SLAE.

The second physical address arithmetic unit SPAE forms a physical address for the working RAM 11 in accordance with the logical address formed by the second logical address arithmetic unit SLAE-.

The drawing data arithmetic unit DEU in FIG. 7 has an arrangement in which an output bus 41, an input-/output bus 42, a read data register RDRW and a memory address register MARW are added to the unit DEU of the first embodiment.

The additional elements are provided in correspondence with the working RAM 11.

The memory address register MARW is supplied with the address for the working RAM 11 from the second physical address arithmetic unit SPAE and through an internal bus UBPS.

The read data register RDRW is supplied with data read out of the working RAM 11, through the input bus 42.

The write data buffer WDB can supply write data to both the input/output bus 21 for the frame buffer 7 and the input/output bus 41 for the working RAM 11.

Accordingly, reading data from the working RAM 11 and supplying write data thereto are executed through the drawing data arithmetic unit DEU.

With this arrangement, the tiling operation can be made fast because the simultaneous access to the frame buffer 7 and the working RAM 11 is permitted.

According to this embodiment, the working RAM 11 as the pattern RAM is not located inside an LSI but is located outside, so that the capacity of the working RAM can be readily enlarged as compared with the capacity of a pattern RAM in a conventional CRT controller. It is therefore possible to draw a complicated and large pattern such as multi-tonal color pattern in the working RAM 11 beforehand and to perform the tiling processing with the pattern.

With the first embodiment shown in FIG. 1, the area to be drawn and the reference pattern exist on the identical drawing memory 7. This leads to the drawback that the tiling etc. must be carried out while the reference pattern on the drawing memory 7 is being variously read out, so the drawing speed of the CRT controller is low accordingly. In contrast, according to the second embodiment, while the CRT controller 4 is writing display data into the drawing memory 7, the working RAM 11 can be accessed in parallel so as to read or write the reference pattern.

The second embodiment therefore has the advantage that the speed of the drawing process employing the reference pattern can be made higher than in the first embodiment.

In the second embodiment, when the data bus length of the bus 10 for connecting the working RAM 11 to the CRT controller 4 is set at 16 bits and an address/data multiplex bus system is adopted, a capacity of up to 128 kilobytes can be afforded to the working RAM 11. In that case, when a color is designated with 4 bits per picture element, a reference area of 512×512 picture elements can be constructed in the working RAM 11.

Embodiment 3

Figure 8:
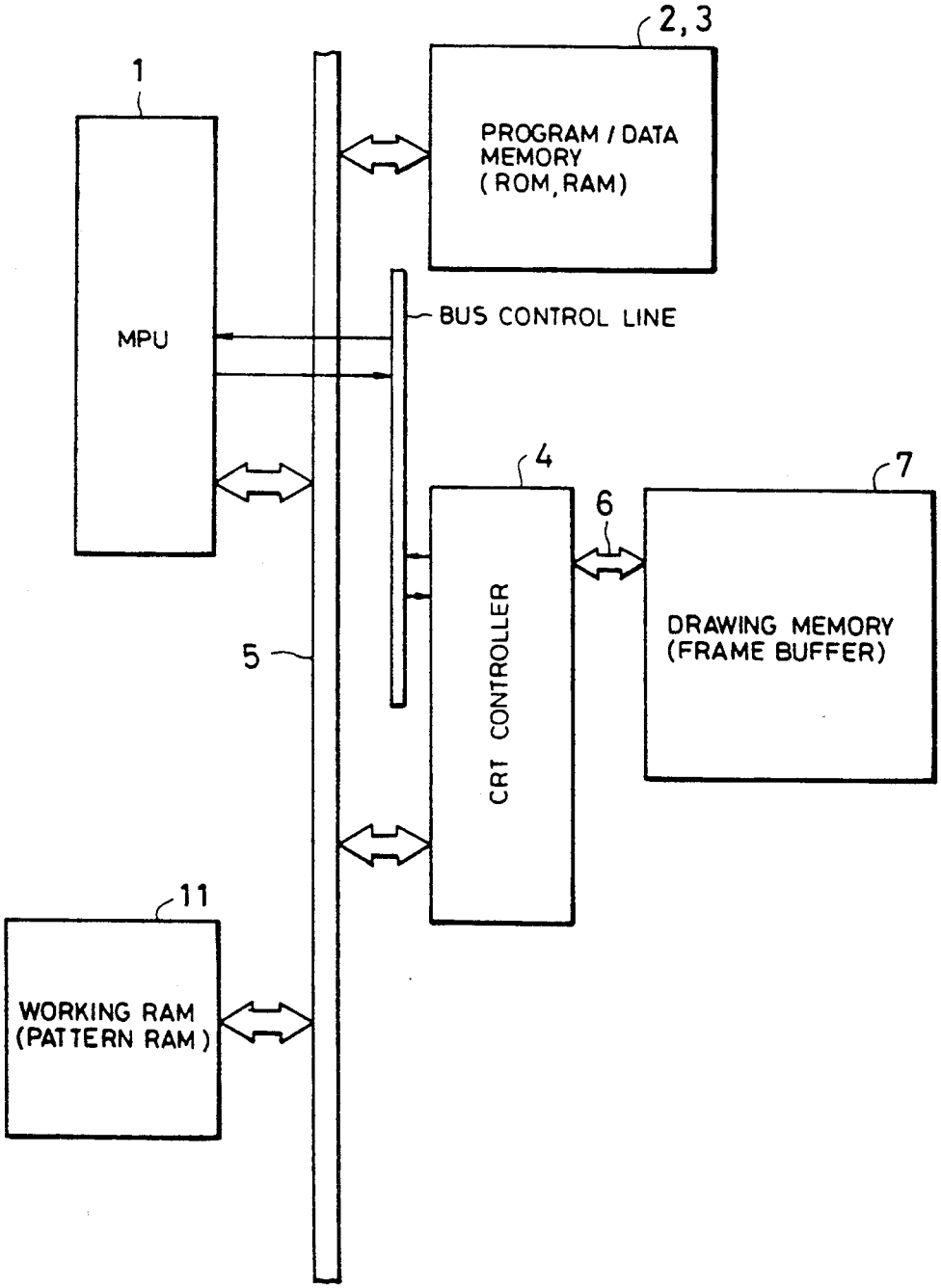
FIG. 8 is a block diagram showing a third embodiment of the present invention.

Next, FIG. 8 shows a third embodiment of the present invention.

This embodiment is such that a working RAM 11 for use as a pattern RAM is connected to a system bus 5 and that the working RAM 11 is put under the controls of both a microprocessor 1 and a CRT. controller 4.

In this embodiment, the CRT controller 4 obtains the right of using the bus from the microprocessor 1 and reads and writes reference pattern data between it and the working RAM 11 by the use of the system bus 5. However, the working RAM 11 need not be provided independently, but a program/data memory 3' having hitherto been under the control of the microprocessor may well be used also as the pattern RAM.

In case of applying this embodiment to a graphic display system, a control circuit to serve as a bus master and the signal lines thereof are added to the system. Besides, the system bus 5 needs to be altered so that it can conform to the address/data multiplex bus system.

In the second embodiment shown in FIG. 6, the working RAM 11 is connected on the side of the drawing memory 7 and separately therefrom, and hence, the number of pins of the CRT controller 4 needs to be increased by the number of bits of the bus 10. In contrast, in the third embodiment, the working RAM 11 is connected to the system bus 5 on the microprocessor side and is accessed through this system bus 5. Therefore, increase in the number of pins to be provided for the CRT controller 4 can be suppressed as compared with that in the second embodiment, and the working RAM 11 can be accessed to read or write the reference pattern in parallel during the writing of the display data into the drawing memory 7, as in the second embodiment.

Further, in this embodiment, the microprocessor 1 can directly access the working RAM 11 and modify the internal reference pattern.

Embodiment 4

Figure 9:
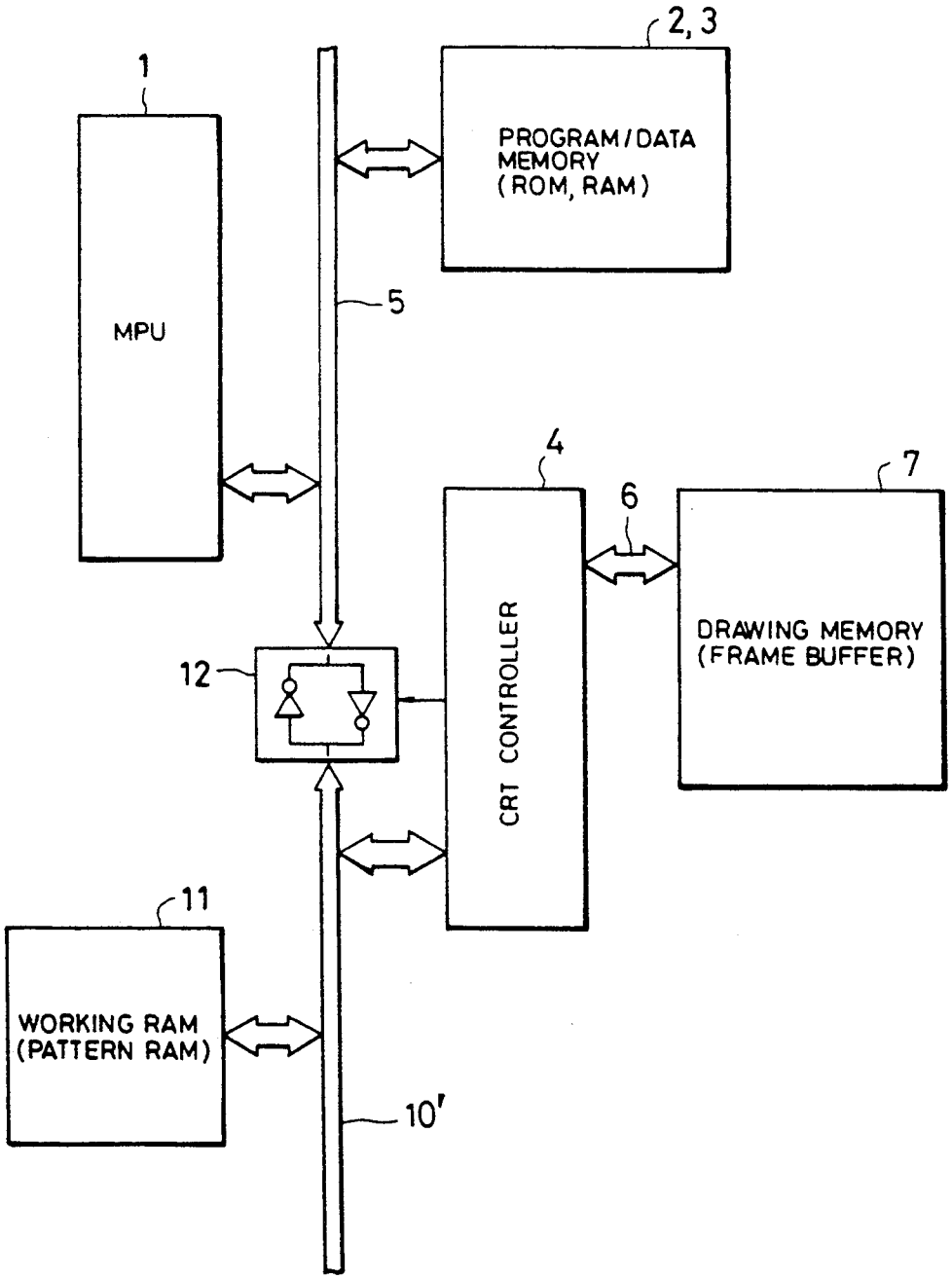
FIG. 9 is a block diagram showing a fourth embodiment of the present invention.

FIG. 9 shows a fourth embodiment of the present invention.

This embodiment is the same as the third embodiment in that a working RAM 11 is connected on the side of a system bus 5. In this embodiment, however, a bus 10 for connecting the working RAM 11 to a CRT controller 4 is connected to the system bus 5 through a bus buffer 12. That is, this bus buffer 12 makes it possible to separate a display controller consisting of the CRT controller 4 and the working RAM 11, from the system body side including a microprocessor 1.

Thus, the CRT controller 4 is permitted to access the working RAM 11 under the state under which the bus 10 is disconnected from the system bus 5.

The third embodiment has the inconvenience that, while the CRT controller 4 is accessing the working RAM 11 by the use of the system bus 5,-the microprocessor 1 cannot operate, so the throughput of the system lowers. In contrast, according to the fourth embodiment, the right of using the system bus 5 is reserved for the microprocessor I even during the access of the CRT controller 4 to the working RAM 11. Therefore, the throughput of the system is not feared to lower.

In case of applying this embodiment, the control of the bus buffer 12 is performed with a proper control signal which is output from the CRT controller 4 and which the microprocessor 1 checks, thereby making it possible to acknowledge whether or not the microprocessor can access the CRT controller 4.

Also in this embodiment, likewise to the third embodiment, the microprocessor 1 can directly access the working RAM 11 so as to modify the internal reference pattern.

Unlike the first embodiment, each of the second to fourth embodiments utilizes the working RAM 11 as the pattern RAM independently of the drawing memory 7. Therefore, the reference pattern needs to be written in the working RAM 11 beforehand. In that case, however, the display data in the drawing memory 7 or the data in the RAM 3 on the system side is transmitted to the working RAM 11 at high speed by the use of a transmission command for the display data, whereby the period of time of the drawing process of the reference pattern can be shortened.

According to this invention, the following effect can be attained:

In place of a pattern RAM which is provided in a CRT controller so as to be used for the tiling processing of a fixed area on a display screen, etc., an external memory such as frame buffer is used as a pattern RAM. Thus, since the external memory can be endowed with a capacity larger than that of the built-in memory, it becomes possible to perform the tiling processing with a comparatively complicated and large reference pattern. This brings forth the effect that the graphic display function of a display control device such as the CRT controller can be expanded without increasing the burden of an MPU.

Although, in the above, the invention made by the inventor has been concretely described in conjunction with embodiments, it is needless to say that the present invention is not restricted to the foregoing embodiments but that it can be variously altered within a scope not departing from the subject matter thereof. For example, although in the embodiments, only the drawing memory (frame buffer) is arranged under the control of the CRT controller, a character-generator and a refresh memory may well be further disposed under the control of the CRT controller as in a conventional system.

While, in the above description, the invention made by the inventor has been chiefly elucidated as to the application to a personal computer which forms the background field of utilization, the invention is not restricted thereto but can be utilized for general systems having display devices such as a work station and a CAD (computer aided design) system.

I claim:

1. A display control device formed as an LSI device for use with an external memory, said display control device being responsive to a drawing command for storing display data in said external memory, comprising:

a plurality of registers which store data for defining a first area in said external memory;

designation means for designating a second area in said external memory, said second area being different from said first area; and means, for performing a predetermined drawing operation between display data stored in said first area and display data stored in said second area, and for storing result display data which is formed by said predetermined drawing operation in said second area as a tiling pattern.

2. A display control device according to claim 1, wherein said registers include a first register for storing start address data for indicating a start position of said first area and a second register for storing end address data for indicating an end position of said first area.

3. A display control device according to claim 2, wherein said first area includes a plurality of areas each of which represents one dot in a drawing, and said second area includes a plurality of areas each of which represents one dot in a drawing, and wherein said drawing operation performing means includes means for sequentially performing said predetermined drawing operation between display data corresponding to said plurality of areas in said first area and display data corresponding to said plurality of areas in said second area, respectively, and means for sequentially storing result display data which is formed by said predetermined sequential drawing operation for said plurality of areas in said second area, respectively.

4. A display control device according to claim 1, wherein said first area includes a plurality of areas each of which represents one dot in a drawing, and said second area includes a plurality of areas each of which represents one dot in a drawing, and wherein said drawing operation performing means includes means for sequentially performing said predetermined drawing operation between display data corresponding to said plurality of areas in said first area and display data corresponding to said plurality of areas in said second area, respectively, and means for sequentially storing result display data which is formed by said predetermined sequential drawing operation for said plurality of areas in said second area, respectively.

5. A display system including a central processing unit, an external memory, a display control device responsive to a drawing command provided from said central processing unit for storing display data in said external memory, and a display unit for displaying display data stored in said external memory on a screen, said display control device being formed as an LSI device and comprising:

a plurality of registers which store data for defining a first area in said external memory;

designation means for designating a second area in said external memory, said second area being different from said first area; and means, for performing a predetermined drawing operation between display data stored in said first area and display data stored in said second area, and for storing result display data which is formed by said predetermined drawing operation in said second area as a tiling pattern.

6. A display system according to claim 5, wherein said registers include a first register for storing start address data for indicating a start position of said first area and a second register for storing end address data for indicating an end position of said first area.

7. A display system according to claim 6, wherein said first area includes a plurality of areas each of which represents one dot in a drawing, and said second area includes a plurality of areas each of which represents one dot in a drawing, and wherein said drawing operation performing means for sequentially performing said predetermined drawing operation between display data corresponding to said plurality of areas in said first area and display data corresponding to said plurality of areas in said second area, respectively, and means for sequentially storing result display data which is formed by said predetermined sequential drawing operation for said plurality of areas in said second area, respectively.

8. A display system according to claim 5, wherein said first area includes a plurality of areas each of which represents one dot in a drawing, and said second area includes a plurality of areas each of which represents one dot in a drawing, and wherein said drawing operation performing means includes means for sequentially performing said predetermined drawing operation between display data corresponding to said plurality of areas in said first area and display data corresponding to said plurality of areas in said second area, respectively, and means for sequentially storing result display data which is formed by said predetermined sequential drawing operation for said plurality of areas in said second area, respectively.

9. A method of forming display data in an external memory by an LSI display control device, the formed display data being displayed on a screen of a display unit, said method of forming display data comprising the steps of:

(a) storing data for defining a first area in said external memory into a plurality of registers which are included in said LSI display control device;

(b) reading out display data stored in said first area in accordance with the data stored in said plurality of registers;

(c) reading out display data stored in a second area in said external memory in accordance with designation of designation means for designating said second area in said external memory, said second area being different from said first area;

(d) performing a predetermined drawing operation between the display data read out from said first area and the display data read out from said second area; and (e) storing result display data which is formed by predetermined drawing operation in said second area as a tiling pattern.

10. A method of forming display data according to claim 9, wherein said registers includes a first register for storing start address for indicating a start position of said first area and a second register for storing end address data for indicating an end position of said first area.

11. A method of forming display data according to claim 10, wherein said first area includes a plurality of areas each of which represents one dot on said screen, and said second area includes a plurality of areas each of which represents one dot on said screen wherein step (d) includes (d1) sequentially performing said predetermined operation between display data corresponding to said plurality of areas in said first area nd display data corresponding to said plurality of areas in said second area, respectively, and wherein step (e) includes (e1) sequentially storing result display data which is formed by said predetermined sequential drawing operation for said plurality of areas in said second area, respectively.

12. A method of forming display data according to claim 9, wherein said first area includes a plurality of areas each of which represents one dot on said screen, and said second area includes a plurality of areas each of which represents one dot on said screen wherein step (d) includes (d1) sequentially performing said predetermined operation between display data corresponding to said plurality of areas in said first area and display data corresponding to said plurality of areas in said second area, respectively, and wherein step (e) includes (e1) sequentially storing result display data which is formed by said predetermined sequential drawing operation for said plurality of areas in said second area, respectively.

* * * * *